US005702229A

United States Patent [19]

Moss et al.

[11] Patent Number: 5,702,229

[45] Date of Patent: Dec. 30, 1997

[54] REGENERATIVE FUEL PUMP

[75] Inventors: Glenn A. Moss, Cass City; Edward J. Talaski, Caro, both of Mich.

[73] Assignee: Walbro Corporation, Cass City, Mich.

[21] Appl. No.: 728,270

[22] Filed: Oct. 8, 1996

[51] Int. Cl.[6] ..... F04D 5/00

[52] U.S. Cl. ..... 415/55.4; 415/55.1; 415/55.2

[58] Field of Search ..... 415/55.1, 55.2, 415/55.3, 55.4, 55.5, 55.6, 200, 186, 187, 208.5; 416/241 A; 417/423.3

[56] References Cited

U.S. PATENT DOCUMENTS

| | | | |
|---|---|---|---|
| 2,042,499 | 6/1936 | Brady | 415/55.1 |
| 3,259,071 | 7/1966 | Nellis et al. . | |
| 4,306,833 | 12/1981 | Sixsmith et al. | 415/55.4 |
| 4,325,672 | 4/1982 | Sixsmith et al. | 415/55.6 |
| 4,678,395 | 7/1987 | Schweinfurter | 415/55.6 |
| 5,257,916 | 11/1993 | Tuckey . | |
| 5,265,997 | 11/1993 | Tuckey . | |
| 5,358,373 | 10/1994 | Hablanian | 415/55.1 |
| 5,409,357 | 4/1995 | Yu et al. | 415/55.1 |
| 5,415,521 | 5/1995 | Hufnagel et al. | 415/55.1 |
| 5,558,490 | 9/1996 | Dobler et al. | 415/55.1 |

FOREIGN PATENT DOCUMENTS

| | | | |
|---|---|---|---|
| 1385066 | 11/1964 | France | 415/55.1 |
| 0173390 | 9/1985 | Japan | 415/55.4 |
| 0105296 | 5/1988 | Japan | 415/55.4 |
| 0147197 | 6/1989 | Japan | 415/55.1 |
| 0111966 | 9/1944 | Sweden | 415/55.1 |

*Primary Examiner*—Christopher Verdier
*Attorney, Agent, or Firm*—Barnes, Kisselle, Raisch, Choate, Whittemore & Hulbert

[57] ABSTRACT

An electric-motor liquid fuel turbine pump wherein the pump impeller periphery has a circumferential array of axial counter flow blades arranged in radially spaced outer and inner concentric circular rows. An arcuate pumping channel includes first and second channel section arcuate grooves axially opposed in side-flanking relationship to the impeller and radially co-extensive with both blade rows to conjointly define a toroidal helical flow path extending circumferentially between the pumping channel inlet and outlet ports. The grooves have a constant radial cross section but the first groove cross sectional area is greater than that of the second groove. The impeller may be a one-piece molded part, or a two-part subassembly of an inner impeller disc and encircling outer impeller ring each having a row of blades formed at its periphery. A pump inlet cap has a top face defining one side plate for the impeller and the first channel groove communicating at one end with the channel inlet. A pump outlet cap has a bottom face defining the other side plate for the impeller and the second channel groove communicating at one end with the channel outlet. A guide ring is sandwiched between the caps and encircles the outer row of impeller blades.

23 Claims, 6 Drawing Sheets

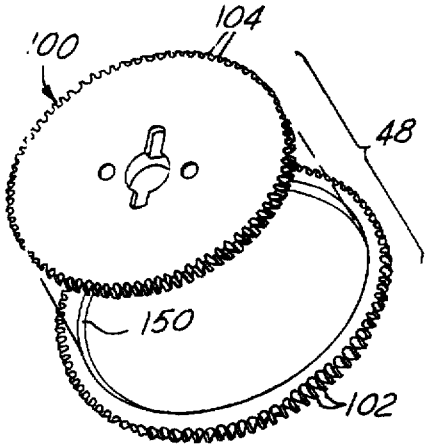
FIG.5
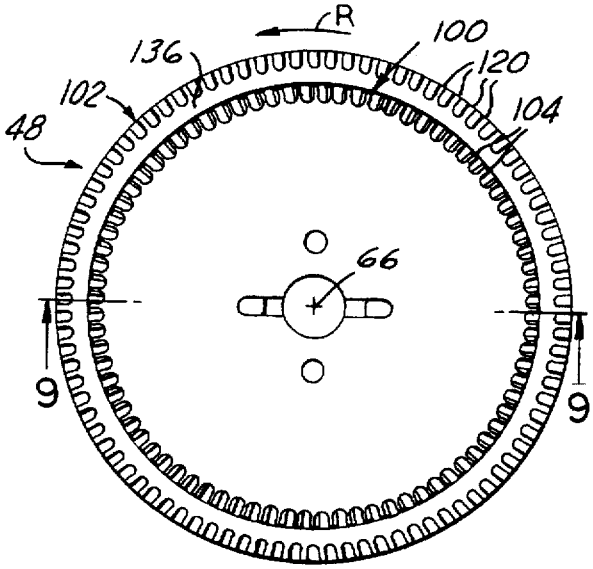
FIG.6
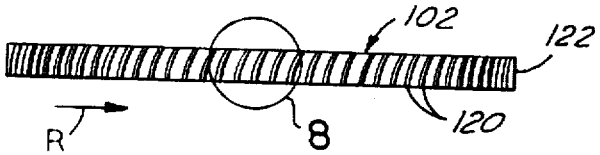
FIG.7
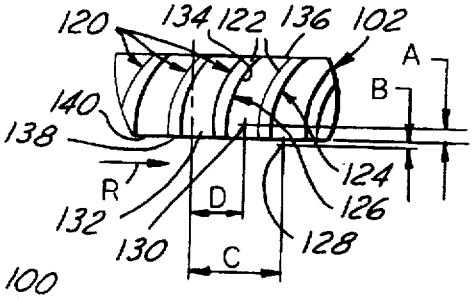
FIG.8
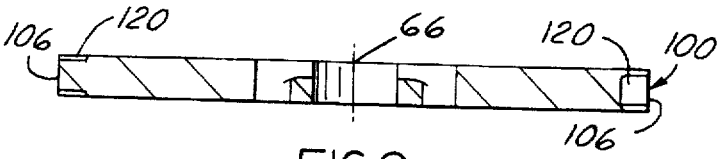
FIG.9
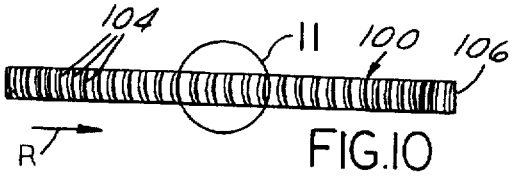
FIG.10
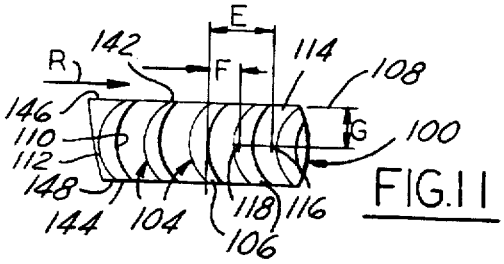
FIG.11
FIG.12
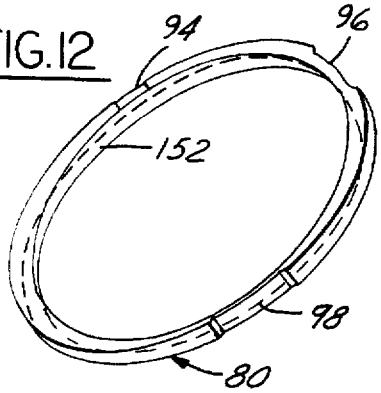

REGENERATIVE FUEL PUMP

FIELD OF THE INVENTION

The present invention is directed to elecro-motor fuel pumps, and more particularly to a turbine-type fuel pump for automotive engine fuel delivery systems and like applications.

BACKGROUND OF THE INVENTION

Electric-motor regenerative pumps have heretofore been proposed and employed in automotive fuel delivery systems. Pumps of this character typically include a housing adapted to be immersed in a fuel supply tank with an inlet for drawing fuel from the surrounding tank and an outlet for feeding fuel under pressure to the engine. An electric-motor includes a rotor mounted for rotation within the housing and connected to a source of electrical energy for driving the rotor about its axis of rotation. An impeller is coupled to the rotor for co-rotation therewith, and has a circumferential array of blades around the periphery of the impeller. An arcuate pumping channel with an inlet port and an outlet port at opposed ends surrounds the impeller periphery for developing fuel pressure through a vortex-like action between the pockets formed by the impeller blades and the surrounding channel. Examples of fuel pumps of this type are illustrated in U.S. Pat. Nos. 3,259,071, 5,257,916 and 5,265,997.

Fuel pumps of this character are subject to a number of design criteria for automotive applications. For example, the fuel pump may be required to deliver fuel at or above a minimum specified flow rate at specified pressure under nominal or normal operating conditions of temperature and battery voltage. The fuel pump may also be required to deliver a specified pressure and minimum flow under low battery voltage conditions, which may occur when it is attempted to start an engine at extremely low temperature. Another design requirement may be to deliver fuel at specified flow rate and minimum pressure under high temperature conditions in which vapor from the hot fuel can play a significant role. Design features and parameters intended to improve performance under some operating conditions can deleteriously affect operation under other conditions.

OBJECT OF THE INVENTION

A general object of the present invention is to provide an electric-motor fuel pump of the described character that features improved performance under a variety of operating conditions, including normal operating conditions, cold starting conditions and hot fuel handling conditions as described above. Another object of the present invention is to provide a pump of the described character that is quiet, economical to manufacture and assemble, and achieves consistent and reliable performance over an extended operating lifetime.

SUMMARY OF THE INVENTION

In general, and by way of summary description and not by way of limitation, an electric-motor fuel pump in accordance with the present invention includes a housing having a fuel inlet and a fuel outlet, and an electric-motor with a rotor responsive to application of electrical power for rotation within the housing. A pump mechanism includes an impeller coupled to the rotor for co-rotation therewith and having a dual concentric circumferential array of blades extending around the periphery of the impeller. An arcuate toroidal pumping channel surrounds at least a portion of the impeller periphery, and is operatively coupled to the fuel inlet and outlet of the housing for delivering fuel under pressure to the housing outlet. The pumping channel is defined by a circumferential pair of channel section grooves that axially flank the radially inner and outer circumferential rows of impeller blades and feed impeller-pumped fuel in a toroidal helical path into and out of the two radially separated concentric rows of impeller blades disposed between these grooves as the fuel is forced circumferentially of the pumping channel from the inlet and outlet ports of the pumping channel. This overall configuration has been found to provide enhanced pump performance, comparable to that obtained with the type of pump set forth in U.S. Pat. No. 5,257,916.

Although the reasons for the improved performance provided by the concentric rows of blades and flanking grooves are not fully understood, it is believed that the blade configuration creates helical flow and enhances forward (or angular) velocity of the fuel about the pump axis as the fuel is pumped through the arcuate pumping channel to thereby enhance pressure build-up pumping action on the fuel, especially at low voltage and pump speed conditions, by increasing the number of "sideways" passes (in toroidal paths in planes parallel to the pump rotational axis) the fuel incrementally makes serially through a plurality of the impeller blades as it travels from the inlet port to the outlet port.

In the preferred embodiment of the invention, a circumferential pair of pumping channel grooves extend almost full circle around the toroidal pumping channel between the channel inlet and outlet ports. The first pumping channel groove is adjacent to the inlet port and is of substantially constant cross section, and is greater in cross sectional area than the second pumping channel groove adjacent to the outlet port. A conventional vapor purge port may open into the first pumping channel groove immediately downstream of the inlet port. The channel grooves preferably are smooth and curved, and the impeller blades between the grooves are of arcuate geometry axially of the impeller. The inner row impeller blades have a radial dimension generally the same as that of the outer row impeller blades and have concave front surfaces facing symmetrically in the direction of impeller rotation for accelerating discharge velocity of fuel from these blades. The outer row impeller blades lean forward and are canted asymmetrically about the lateral center plane of the impeller to increase tangential velocity of fuel flow relative to ground (i.e., housing) as they force the fuel from the first to the second channel groove at the outer periphery of the impeller. The outer blades also induce a decrease in the lead angle relative to a plane through the pump axis of helical fuel flow in the toroidal pumping channel. Both the inner and outer blades thus have concave front surfaces facing generally in the direction of impeller rotation with their leading and trailing edges respectively adjacent to the second and first channels. In a modification of the first and second pumping channel grooves, stator vanes may be statically disposed at least in one of the first and second pumping channel grooves to further induce diminishing of the lead angle of the helical fuel flow in the pumping channel, as well as to automatically limit maximum output pressure developable by the pump.

In one embodiment the impeller is a two-piece subassembly and in another is molded as a one-piece part. In the first embodiment the inner row of blades extend around the periphery of an inner impeller disc, and the outer blades extend around the periphery of an outlet impeller ring having its inner periphery press fit onto the outer edges of the disc blades. Preferably the first and second pumping channel grooves are formed respectively in inlet and outlet caps that form side plates in the pump housing flanking the impeller. A guide ring is sandwiched between the caps and has a cylindrical inner wall encircling the outer impeller ring closely adjacent to the outer edges of the outer blades. The combination of this thin impeller with its dual concentric axial flow blade rows and the helical recirculation flanking channel grooves of the cap side plates has been found to yield enhanced efficiency comparable to the pump of the aforementioned '916 patent, while also meeting desired minimum performance characteristics of the same at normal operating conditions, without requiring regenerative pockets to be formed in an interrupted pattern in the side plates adjacent to the grooves as in the '916 patent. A simplified clog-free geometry and economy of manufacture and operation are thus obtained without sacrificing performance characteristics.

BRIEF DESCRIPTION OF THE DRAWINGS

The invention, together with additional objects, features and advantages thereof, will become apparent from the following detailed description of the preferred embodiments and best mode, the appended claims and the accompanying drawings (which are to engineering scale unless otherwise indicated) in which:

FIG. 5 is a exploded perspective view of the inner and outer impellers of the pump of the assembly of FIG. 1 shown by themselves and on a reduced scale relative to that of FIGS. 1–4.

FIG. 6 is a top plan view of the inner and outer impeller subassembly of the pump of the assembly of FIG. 1.

FIG. 7 is a side elevational view of the outer impeller of FIG. 6.

FIG. 8 is a fragmentary view of the portion encompassed by the circle 8 of FIG. 7 and greatly enlarged thereof.

FIG. 9 is a cross sectional view taken on the line 9—9 of FIG. 6.

FIG. 10 is a side elevational view of the inner impeller of FIG. 6.

FIG. 11 is a fragmentary view of the portion of FIG. 10 encompassed by the circle 11 therein and greatly enlarged thereover.

FIG. 12 is a perspective view of the guide ring of the pump of the assembly of FIG. 1.

FIG. 16 is a fragmentary cross sectional view taken on the line 16—16 of

FIG. 14 and greatly enlarged thereover.

DETAIL DESCRIPTION OF PREFERRED EMBODIMENTS

Figure 1:
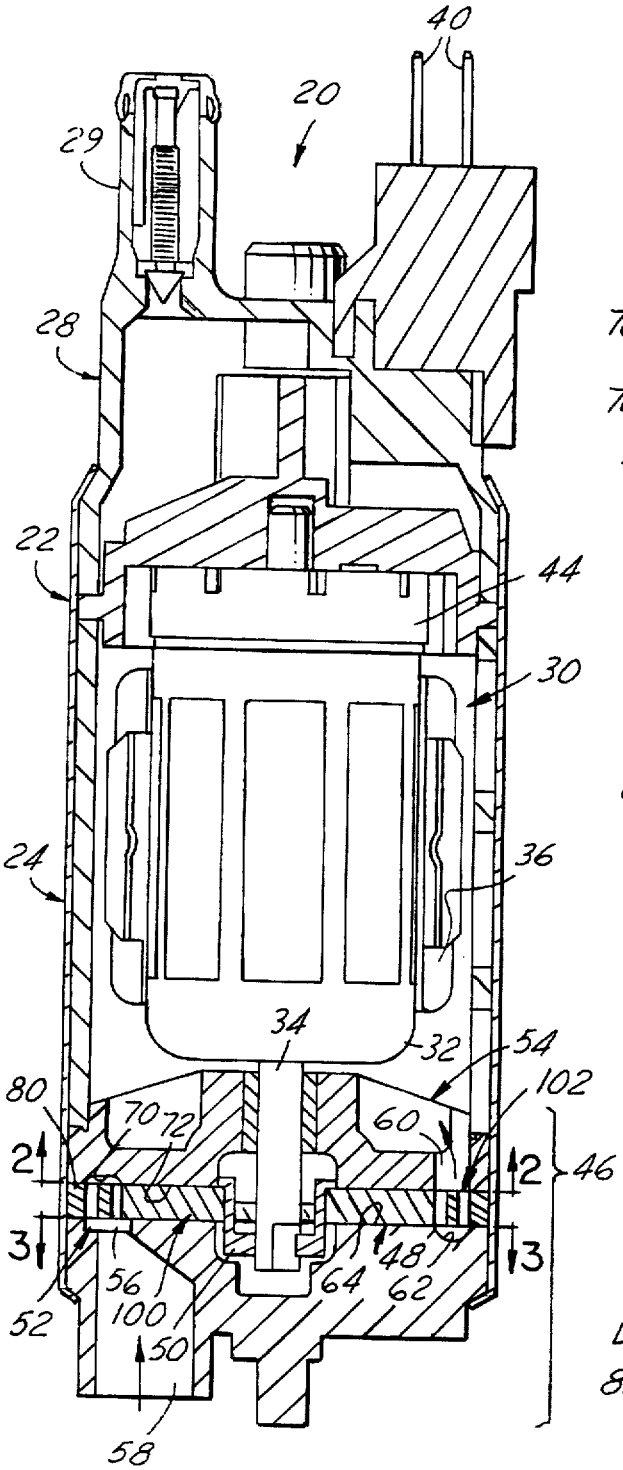
FIG. 1 is a part center sectional view (taken in part on the section lines 1—1 of FIGS. 2 and 3) and pan side elevational view illustrating an electric-motor fuel pump assembly in accordance with a first embodiment of the invention.

FIG. 1 illustrates an electric-motor fuel pump assembly 20 in accordance with a first embodiment of the invention as comprising a housing 22 formed by a cylindrical case 24 that joins axially spaced inlet and outlet end caps 26 and 28 respectively. An electric-motor 30 is formed by a rotor 32 journaled by a shaft 34 for rotation within housing 22 and by surrounding permanent magnet stator 36. Suitable commutation brushes (not shown) are disposed within outlet end cap 28 and electrically connected to terminals 40 positioned externally of end cap 28. The brushes are urged by associated springs (not shown) into electrical sliding contact with a commutator plate 44 rotatably carded by rotor 32 and shaft 34 within housing 22. To the extent thus far described, pump 10 is generally similar to those disclosed in U.S. Pat. Nos. 4,352,641, 4,500,270 and 4,596,519.

The motor-pump assembly 20 includes a liquid fuel pumping mechanism ("pump") 46 mounted at the lower end of case 24 that includes housing end cap 26 serving as the inlet cap of the pump. In accordance with one feature of the present invention, pump 46 includes a dual-bladed, axial counterflow impeller 48 that is coupled to shaft 34 by a U-shaped spring clip key 50 for co-rotation therewith. In accordance with another feature of the present invention, an arcuate toroidal pumping channel 52 axially flanks and flow communicates the axially opposed side edges of both concentric sets of inner and outer turbine blades of impeller 48. Channel 52 is formed by a channel section groove 62 in inlet end cap 26 and by a channel section groove 70 in an outlet cap 54 on the axially opposite side of impeller 48, the inlet and outlet caps 26 and 54 thus forming the impeller side plates. The central outer periphery of pumping channel is formed by a guide ring 80 that is sandwiched in assembly axially between caps/plates 26, 54 to provide a cylindrical wall that closely surrounds the outer peripheral edges of the outer blades of impeller 48. Pumping channel 52 has an axially opening inlet port 56 at its inlet end connected to an inlet passageway 58 that projects downwardly from end cap/side plate 26, and has an axially opening outlet port 60 at its circumferentially opposing outlet end communicating through outlet cap/plate 54 to the interior of housing 22. Fuel is thereby pumped by impeller 48 from inlet 58 through pumping channel 52 into housing 22 through which it flows to an outlet 29 on casing end cap 28.

Figure 2:
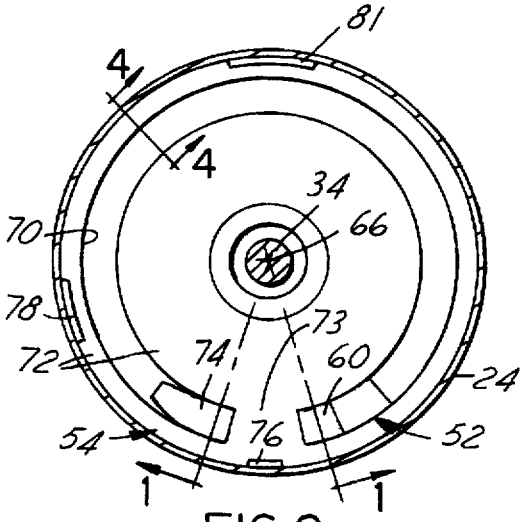
FIG. 2 is a cross sectional view taken on the line 2—2 of FIG. 1 and illustrating in plan view the underside of the outlet cap of the pump of the assembly of FIG. 1.
Figure 3:
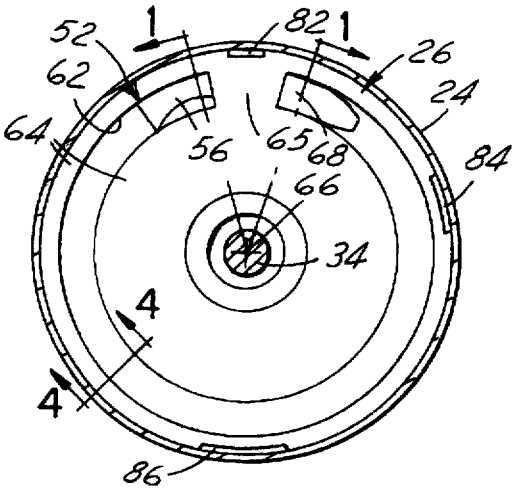
FIG. 3 is a cross sectional view taken on the line 3—3 of FIG. 1 and illustrating in plan view the upperside of the pump inlet cap of the assembly of FIG. 1.
Figure 4:
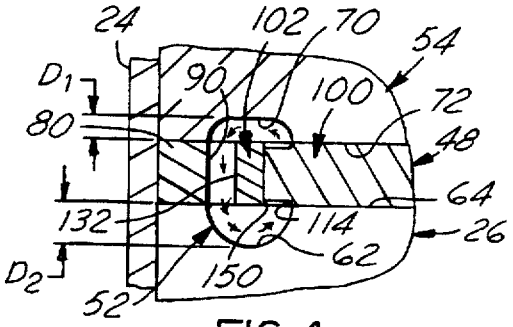
FIG. 4 is a fragmentary view of a portion of the pump of the assembly of FIG. 1 taken on the lines 4—4 of FIGS. 2 and 3 and greatly enlarged thereover.
Figure 13:
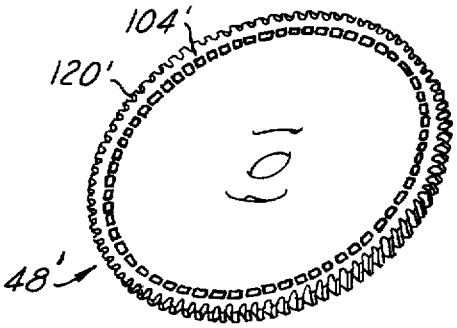
FIG. 13 is a perspective view of a modified one-piece impeller for use in the pump of the assembly of FIG. 1.
Figure 14:
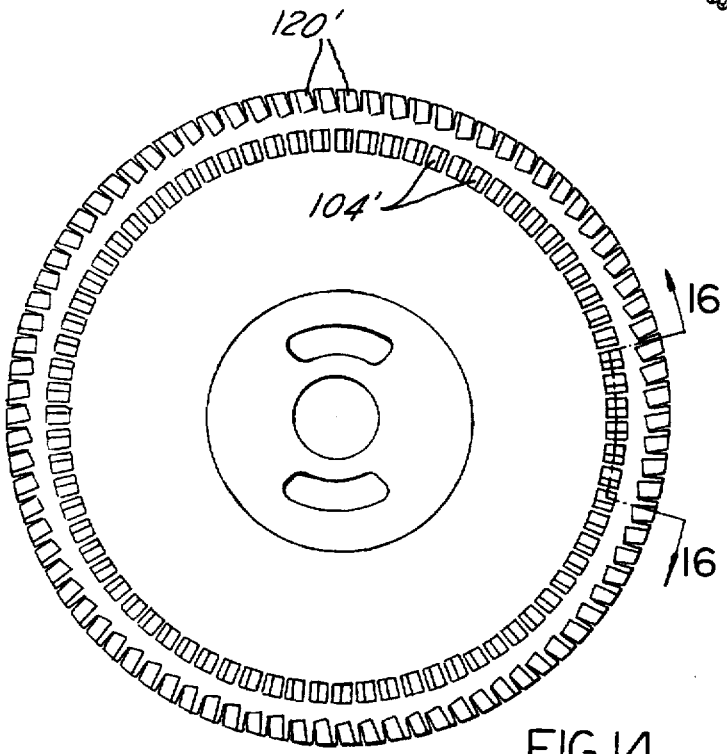
FIG. 14 is a top plan view of impeller of FIG. 13.
Figure 18:
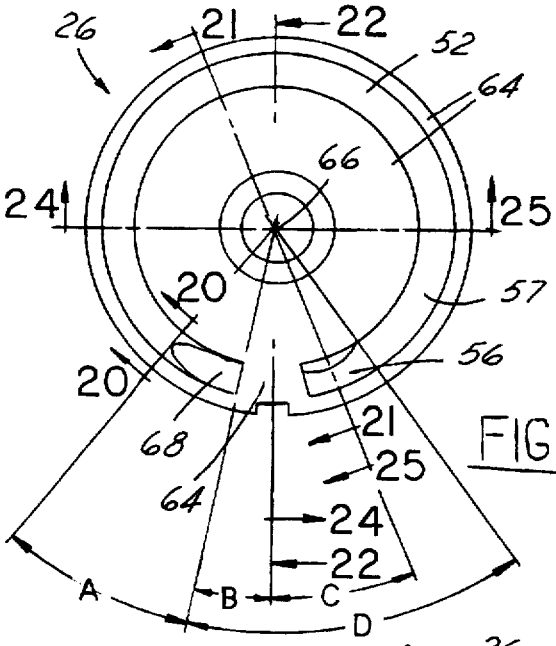
FIG. 18 is a top plan view of the pump inlet cap of the pump assembly of FIGS. 1 and 3, the cap being shown by itself.
Figure 24:
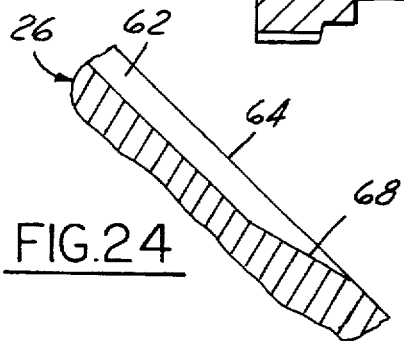
FIGS. 24 and 25 are fragmentary cross sectional views respectively on the lines 24—24 and 25—25 of FIG. 18, FIG. 24 being greatly enlarged thereover.

Outlet and inlet caps/plates 54 and 26 are illustrated in greater detail in the bottom and top plan views of FIGS. 2 and 3 respectively, and in the enlarged fragmentary view of FIG. 4. A presently preferred form of the inlet cap 26 is shown by itself in even greater detail in FIGS. 18–25, and likewise as to the outlet cap 54 in FIGS. 26–33. Referring first to FIGS. 3, 18, 20–22, 24 and 25, the torroidal pumping channel 52 defined in part by arcuate groove lower channel section 62 formed in the flat top face 64 of inlet cap/side plate 26. As shown in FIGS. 3 and 18, lower channel 62 extends from inlet portion 56 around face 64, at a constant radius from the central axis 66 of the pump/motor, to a liquid expulsion exit ramp 68 (FIG. 24) angularly adjacent to but spaced from inlet port 56 by face 64. If desire, a vapor purge port (not shown) may be provided opening to channel section 62 near inlet port 56, but suitably spaced downstream thereof, and extending downwardly through inlet cap 26 for purging vapor from the pumping channel to the exterior of the pump/motor in accordance with conventional practice. Preferably channel section 62 is of uniform cross sectional configuration (as cut in any plane drawn radially and axially of inlet cap 26) throughout its arcuate extent, and is preferably configured in cross section as best seen in the enlarged views of FIGS. 4 and 20. Inlet port 56 is of generally curved rectilinear segment shape in cross section with its major axis extending circumferentially and registers with both blades 104 and 120 of impeller 48.

Figure 25:
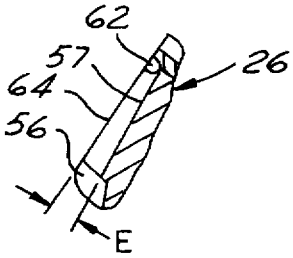
Figure 20:
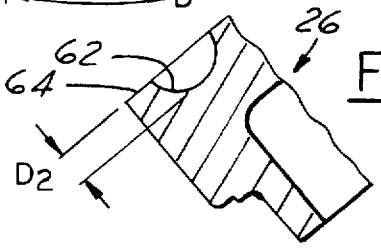
Figure 30:
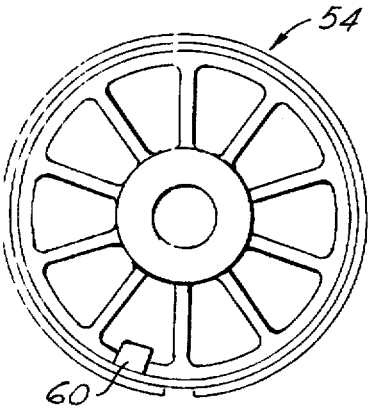
FIG. 30 is a top plan view of the cap shown in FIG. 26.
Figure 28:
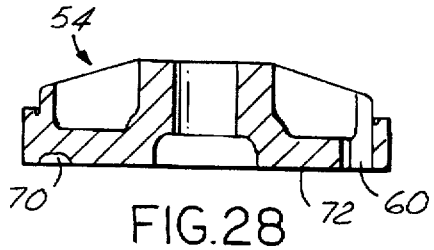
FIGS. 27, 28 and 29 are cross sectional views taken respectively on the lines 27—27, 28—28 and 29—29 of FIG. 26.
Figure 29:
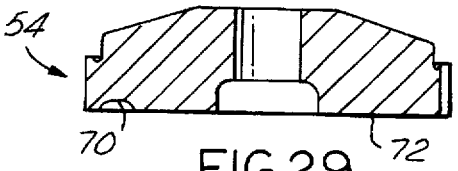

Preferably, in order to reduce flow-directional-change induced flow path resistance, and as best seen in FIGS. 18 and 25, the liquid entrance flow path from inlet port 56 into lower channel 62 is faired off from a right angle transition by an angled entrance ramp 57 convergent in a downstream direction toward cap face 64. Entrance ramp 57 rises at an angle E of about 5° (FIG. 25) to face 64 to meet the bottom depth $D_2$ (FIG. 4) of channel section 62 preferably about 68° downstream from the center inlet port 56.

Figure 26:
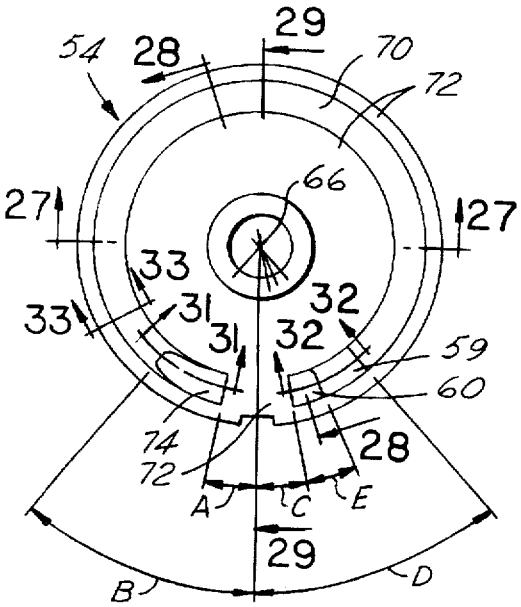
FIG. 26 is a bottom plan view of the pump outlet cap of the pump assembly shown in FIGS. 1 and 2, the cap being shown by itself.
Figure 31:
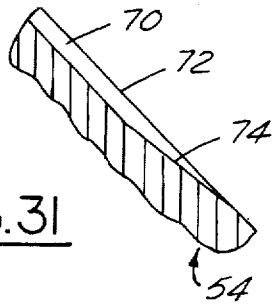
FIGS. 31, 32 and 33 are fragmentary cross sectional views taken respectively on the lines 31—31, 32—32 and 33—33 of FIG. 26, FIGS. 31 and 33 being greatly enlarged thereover.
Figure 32:
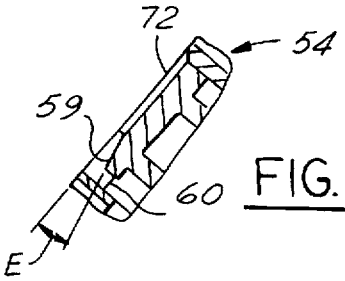
Figure 27:
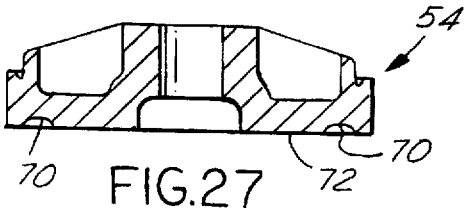
Figure 33:
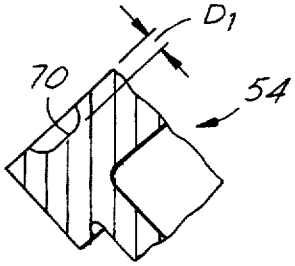

Likewise, preferably, as best seen in FIGS. 26 and 32, the liquid exit flow path from upper channel section 70 into outlet port 60 is faired off by an angled exit ramp 59 rising from the max depth $D_1$ (FIG. 4) of upper channel section 70 preferably at about an angle E of about 15° (FIG. 32) divergent in a downstream direction from face 72. The upstream end of exit ramp 59 is located preferably about 18° from the downstream junction of ramp 59 with port 60.

In the pump assembly the notches 76, 78 and 81 in outlet cap/side plate 54 are aligned in registry with notches 82, 84 and 86 respectively of inlet cap/side plate 26 so that lead-in ramp 74 in the upper cap or side plate 54 axially opposes inlet port 56 and lead-in ramp 57 in the lower cap or side plate 26, and likewise exit ramp 68 in side plate 26 axially opposes exit ramp 59 and outlet port 60 in side plate 54. Thus, with the exception of their ports, associated ramps and depth dimensions parallel to axis 66, channel sections 62 and 70 are generally the mirror image of one another to thereby define the axially opposed side boundaries of the toroidal pumping channel 52.

Pumping channel 52 is also defined in part by the impeller guide ring 80 (FIGS. 1, 4 and 12) that is sandwiched in assembly between top face 64 of inlet cap/side plate 26 and bottom face 72 of outlet cap/side plate 54 so as to radially encircle impeller 48 at its outer periphery. The radially inner face 90 of ring 80 is a flat cylindrical surface extending parallel to axis 66 to thereby define the outer wall of pumping channel 52, and is disposed in alignment with the radially outer edges of the flanking channel sections 62 and 70. Notches 94, 96 and 98 (FIG. 12) in ring 80 cooperate with the corresponding notches 76,78 and 81 in plate 54 and notches 82, 84 and 86 in plate 26 to align these three components in assembly.

Referring to FIGS. 5–11, it will be seen that impeller 48 may be constructed in a first embodiment as a two-part dual impeller subassembly made up of an inner impeller 100 and an outer impeller 102. As best seen in FIGS. 6, 10 and 11, inner impeller 100 preferably comprises a solid, thin flat disc of rectangular radial cross section having radially projecting blades 104 of uniform thickness and angular spacing that form the radially inner row of impeller blades. Inner blades 104 each have a rectangular outline in frontal elevation, and the outer end edges 106 of blades 104 collectively define an interrupted cylindrical periphery of impeller 100 concentric with axis 66. As best seen in FIG. 11 each blade 104 is scooped-shaped in end view elevation with a curvature symmetrical about the lateral center plane 108 of impeller 100, as defined by a concave front face 110 and a convex trailing face 112 each of which extends radially straight outwardly relative to axis 66 from a concave root surface 114 formed between each adjacent pair of blades 104. Blade front surface 110 has a constant radius of curvature drawn from a center 116 which is somewhat greater than the constant radius of curvature of rear face 112 dram from center 118, as shown by the generating diagram in FIG. 11. However, it will be understood that, if desired, the finite cross sectional configuration of blades 104 may be further optimized in accordance with conventional design parameters available to those skilled in the art in standard turbo machinery technical manuals, e.g., feathered edges terminating in radiused tips, etc.

Outer impeller 102 is in the form of a solid ring of rectangular radial cross section having radially outwardly projecting blades 120 surrounding its outer periphery (FIGS. 6, 7 and 8) of uniform thickness and angular spacing that form the radially outer row of impeller blades. Outer blades 120 each have an outer end edge 122 extending parallel to axis 66, outer blade edges 122 thereby collectively defining an interrupted cylindrical periphery of outer impeller 102 concentric with axis 66. Each blade 120 has a concave front face surface 124 and a convex rear face surface 126. The constant radius of curvature of blade leading face 124, generated about center 128 (FIG. 8), is greater than the constant radius of curvature generated about center 130 of blade trailing face 126, as shown by the generating diagram of FIG. 8. Blades 120 also extend radially straight outwardly relative to the axis 66 of the impeller from flat intervening root surfaces 132. However, outer blades 120 are canted to lean forward so as force fuel from the radially outer region of upper channel section 70 downwardly into the radially outer region of lower channel 62, and due to their concave faces being canted they define flow channels having outlets directed generally axially into lower channel section 62 to thereby reduce velocity of fuel flow relative to the blades but increase tangential velocity of fuel flow relative to the housing.

More particularly, the operational direction of rotation of impeller 48 is indicated by the arrow R in FIG. 6 and by the similar directional rotational arrows R of FIGS. 7, 8, 10 and 11. Thus, as best seen in FIG. 8 blades 120 of outer impeller ring 102 are inclined relative to the direction of impeller rotation R at the angle shown in FIG. 8 such that the leading side edge 134 of each outer blade 120 is generally flush with the top face 136 of outer impeller ring 102, and the axially opposite trailing edge 138 of each outer blade 120 is generally flush with the flat bottom face 140 of impeller ring 102. By contrast, the top and bottom side edges 142 and 144 of inner blades 104 of inner impeller disc 100 (FIG. 11) are aligned with one another axially of impeller disc 100, but are also respectively generally flush with the flat top and bottom faces 146 and 148 of impeller disc 100.

In assembly of the inner impeller disc 100 into outer impeller ring 102 the outer blade edges 106 of inner impeller blades 104 have a press fit with the cylindrical inner surface 150 of outer impeller ring 102 (FIG. 5). Hence in such assembly of impeller disc and ring parts 100 and 102 to form impeller subassembly 48 the two parts are held securely together with their respective top faces 136 and 142 flush, and likewise as to their respective bottom faces 140 and 148.

In assembly of impeller 48 in pump 46 as shown in FIGS. 1 and 4, the outer peripheral edges 122 of outer blades 120 of impeller ring 102 rotate with a slight clearance adjacent the cylindrical inner surface 152 of guide ring 80 (FIG. 12). The root surfaces 114 of inner impeller disc 100 are aligned axially of the pump with the radially inner edges of channel sections 62 and 70, as best seen in FIG. 4. The guide ring surface 90 is aligned axially with the radially outermost edges of these channel sections as also shown in FIG. 4.

The spaces between the mutually facing front and rear faces 110, 112 of each adjacent pair of inner blades 104, together with their intervening root surface 114 and the wall means of the inner face 150 of outer impeller ring 102, define individual blade fuel flow pockets communicating axially of the pump between lower channel section 62 and upper channel section 70 that define scoops tending to accelerate tangential velocity relative to the housing and reverse tangential flow direction relative to these pockets in pumping channel 52. However, the spaces between the mutually facing front and rear faces 124, 126 of adjacent outer blades 120 of impeller ring 102, together with their associated root surfaces 132 and the inner surface 90 of guide ring 80, define individual blade fuel flow pockets extending axially between upper channel section 70 and lower channel section 62 adjacent the outer periphery of impeller 48 that act to increase fuel flow tangential exit velocity while augmenting helical circulation in the pumping channel.

It thus will be seen that the concentric array of inner and outer blades 104 and 120 define, in conjunction with the lower and upper channel sections 62 and 70 and guide ring 80, the toroidal arcuate pumping channel 52. Preferably this pumping channel 52 is asymmetrical in radial cross section in the sense that the depth $D_1$ of upper channel section 70 is less than the depth $D_2$ of the lower channel section 62. Also, as best seen by comparing FIGS. 20 and 33, lower channel section 62 preferably has a constant radius of curvature in radial cross section, whereas in radial cross section upper channel 70 preferably has a semi-oval shape with a flattened central portion. The radial depth of the flow pockets between vanes 104 of inner impeller disc 100 preferably is approximately the same as that of the flow pockets defined between blades 120 of outer impeller ring 102.

In the operation of pump 46 when rotationally driven by motor 30 in the direction of rotation R, the inner and outer impeller disc and ring 100 and 102 rotate as a unit to pump fuel from inlet port 56 around pumping channel 52 to outlet port 60 by the vortex pumping action generally characteristic of this turbine type of pump. That is, pump 46 operates generally in a manner similar to a turbine style pump with the impeller blades developing both forward thrust and centrifugal forces on the fuel entrained by the blades at inlet port 56 and then pressurized and expelled downstream at the outlet port 60.

However, in addition to this centrifugal rotary blade pump action, the toroidal pumping channel 52 in cooperation with the radially spaced concentric dual array of axial counterflow impeller blades 104 and 120 creates a helical pumping flow path of the fuel in pumping channel 52, the radial component of this helical path being indicated diagrammatically by the small arrows in FIG. 4. As impeller 48 rotates in its sweep of the pumping channel 52 between inlet port 56 and outlet port 60 the incoming fuel will be accelerated and increasingly pressurized as it is forced tangentially so as to exit axially upwardly while being flung forwardly out of the scoop pockets of inner blades 104 into upper channel section 70, thereby increasing its tangential force vector relative to the path of impeller rotation. The shallower depth of upper channel section causes less reduction in tangential velocity than occurs in the deeper lower channel and thus promotes pumping regenerative action velocity increase. The fluid is thus forced radially outwardly by centrifugal force, and circumferentially tangentially by momentum forces, in channel section 70 and then is picked up at the outer edge of channel 70 by outer blades 120 of impeller 48.

The counterclockwise circulation of this helical fuel flow, as viewed in FIG. 4, is induced or aided by the canted inclination of outer blades 120 of impeller 48. These outer blades in turn then force the fuel to exit primarily downwardly from their flow pockets axially into the outer region of lower channel 62, as well as increasing tangential or circumferential flow velocity into channel section 62. The pressure differential forces so created force the fuel to travel radially inwardly as well as circumferentially (i.e., helically) back to the pumping pockets of inner vanes 104 of impeller 48. This radially inwardly motion of the fluid during its toroidal helical circulation causes an acceleration in lower channel section 62 (figuratively compare the familiar sight of spinning figure skaters accelerating bodily spin by moving their outstretched arms inwardly against their bodies).

Again, the increasing resistive pressure differential forces created in pumping channel 52 in the incremental flow of fluid from inlet port 56 to outlet port 60 act to oppose and radially redirect tangential motion of the fluid upon exiting from both blades 104 and 120, thereby further augmenting helical versus flow circumferentially of impeller 48 and channel 52. Preferably this toroidal flow path will cause each increment of the fuel to pass through as many of the inner and outer blade pockets as possible during the circular path sweep of the fuel increment between its entrance to channel 52 at inlet port 56 and exit from the channel at outlet port 60 so as to maximize the energy input blade pumping action and thereby enhance overall fuel pump efficiency.

Moreover, the forward-throw shape of the blade pockets of inner impeller blades 104 is such as to maximize exit velocity of fuel leaving these pockets as the same is forced axially into upper channel section 70, whereas the shape of the outer impeller pockets imparts tangential exit velocity equal to that of the blade. The inner and outer blades thus cooperate to decrease the helix angle of the toroidal flow path and thereby augment the extent of circulation of the fuel in the toroidal flow path during its sweep of pumping channel 52. In addition, since the depth $D_1$ of upper channel 70 is preferably made shallower than the depth $D_2$ of lower channel 62, the resultant flow velocity increase caused by this localized narrowing of the pumping channel helical flow path thereby increases the radial centrifugal forces acting on the fuel being discharged upwardly into channel 70 from the pockets of blades 104 of inner impeller 100. These blade and channel section shape features thus cooperate to offset the countervailing forward throw effect caused by the greater tangential velocity of outer row blades 120 relative to that of inner row blades 104.

The fuel pump herein disclosed has been found to exhibit superior efficiency and comparable starting and hot fuel handling performance to that achieved with the regenerative pump construction of the aforementioned U.S. Pat. 5,257,916, without significantly detracting from performance under normal conditions. This result has been achieved without the need to form any regenerative pockets in the side plates as set forth in the aforementioned '916 patent. Rather pumping action is achieved with easily formed, smooth channel half sections 62 and 70 formed in the associated sides of the pump. The smooth walled annular or arcuate channel sections 62 and 70 thus have a clog-free geometry to thereby enhance efficiency, reliability and operational life of the pump. A reduction in thickness of impeller 48 was also achieved without decreasing performance results as compared to a pump of the type set forth in the '916 patent having comparable performance characteristics. The geometry of guide ring 80 is also simplified and provides a smooth, clog-free outer wall 152 in the annular pumping channel 52. Pump 46 also has been found to be quiet in operation, and is economical to manufacture and assemble.

In one successful working embodiment of an electric-motor fuel pump assembly 20 constructed in accordance with the foregoing description, as illustrated in the drawing FIGS. 1–12 and 18–33, the following exemplary parameters were observed:

| Parameters | Values |
|---|---|
| Diameter of outer impeller 102 | 32 mm |
| Diameter of inner impeller 100 | 28 mm |
| Thickness of impellers 100 and 102 | 2 mm |
| Material of impellers 100 and 102 and of caps 26 and 54 | PPS |
| Dimension $D_1$ of upper channel section 70 | 0.88 mm |
| Dimension $D_2$ of lower channel section 62 | 1.39 mm |
| Radius of curvature of: | |
| Blade face 124 | 2.67 mm |
| Blade face 126 | 2.23 mm |
| Blade face 110 | 1.58 mm |
| Blade face 112 | 1.21 mm |
| Lay-out dimensions in FIGS. 8 and 11: | |
| Dimension A | 0.37 mm |
| Dimension B | 0.12 mm |

-continued

| Parameters | Values |
|---|---|
| Dimension C | 2.08 mm |
| Dimension D | 1.18 mm |
| Dimension E | 1.58 mm |
| Dimension F | 0.79 mm |
| Dimension G | 1.00 mm |
| In FIGS. 18 and 25 angles: | |
| A | 40° |
| B | 12° |
| C | 22° |
| D | 36° |
| E | 5° |
| In FIGS. 26 and 32, angles: | |
| A | 12° |
| B | 40° |
| C | 12° |
| D | 42° |
| E | 15° |

Second Embodiment Impeller

Figure 16:
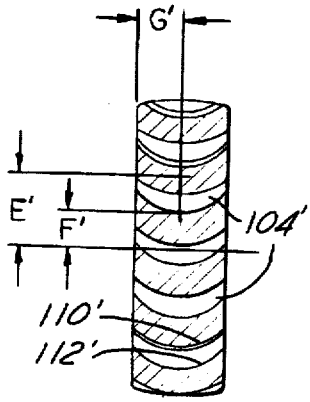
Figure 15:
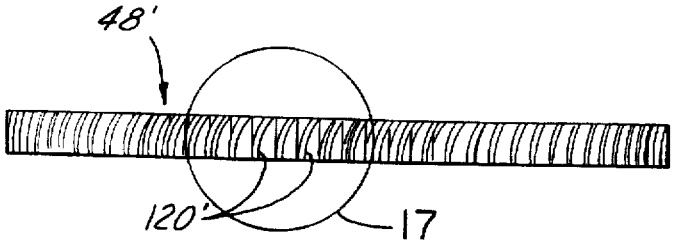
FIG. 15 is a side elevational view of impeller of FIGS. 13 and 14.
Figure 17:
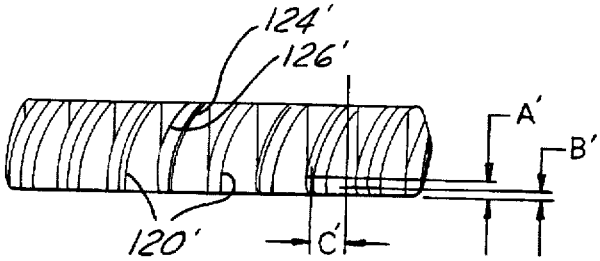
FIG. 17 is a fragmentary elevational view of the portion of FIG. 15 encompassed by the circle 17 therein and greatly enlarged thereover.
Figure 23:
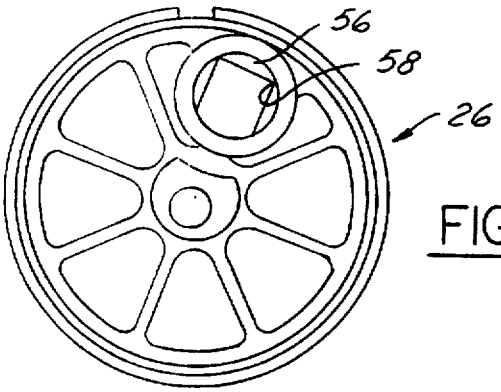
FIG. 23 is a bottom plan view of the inlet cap of FIG. 18.
Figure 21:
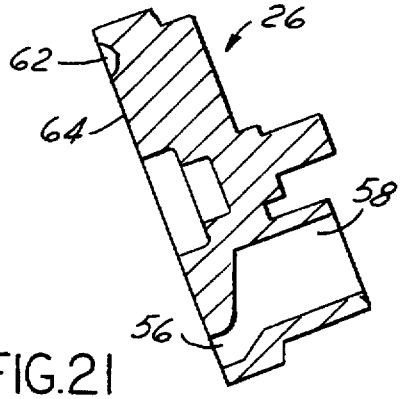
FIGS. 20, 21 and 22 are cross sectional views respectively taken on the lines 20—20, 21—21 and 22—22 of FIG. 18, FIG. 20 being greatly enlarged thereover.
Figure 19:
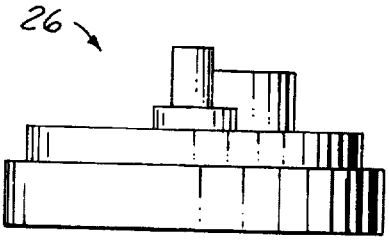
FIG. 19 is a side elevational view of the cap of FIG. 18.
Figure 22:
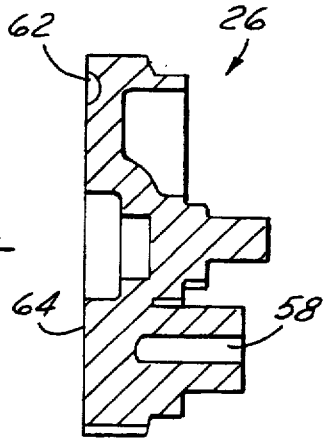

FIGS. 13–17 illustrate a second embodiment of an impeller 48' which is similar to impeller 48 as described and illustrated previously hereinabove except that it is injection molded in one piece from a suitable plastic material, such as FORTRON 6165 A4 from Celanese. Corresponding elements are given like reference numerals raised by a prime suffix and their description not repeated, the construction being clearly shown to scale in the drawing figures which are part of this specification. It will be seen that outer row blades 104' and 120' have a wider blade spacing than that of the corresponding blades 104 and 120 of impeller 102. As illustrated, impeller 48' has seventy-five equally spaced blades 104' in the inner row, and eight-six equally spaced blades 120' in the outer row, as compared to eighty inner row blades 104 and ninety outer row blades 120 of impeller 102 (compare FIGS. 17 and 8). Blades 104' and 120' are laid out in accordance with the lay-out diagrams of FIGS. 16 and 17 according to the following exemplary dimensional parameters:

| | |
|---|---|
| In FIG. 16: | |
| Radius of curvature 110' | 1.58 mm |
| Radius of curvature 112' | 1.21 mm |
| Dimension E' | 1.58 mm |
| Dimension F' | .79 mm |
| Dimension G' | 1.0 mm |
| In FIG. 17: | |
| Radius of curvature 124' | 2.67 mm |
| Radius of curvature 126' | 2.23 mm |
| Dimension A' | 0.38 mm |
| Dimension B' | 0.17 mm |
| Dimension C' | 0.71 mm |

As presently understood and determined, it is believed that the modified impeller 102' will provide somewhat improved performance results and/or will be less costly to manufacture in volume as compared to the two-piece impeller embodiment 102 and hence is presently preferred.

Stator Vane Inlet Cap Embodiment

Figure 34:
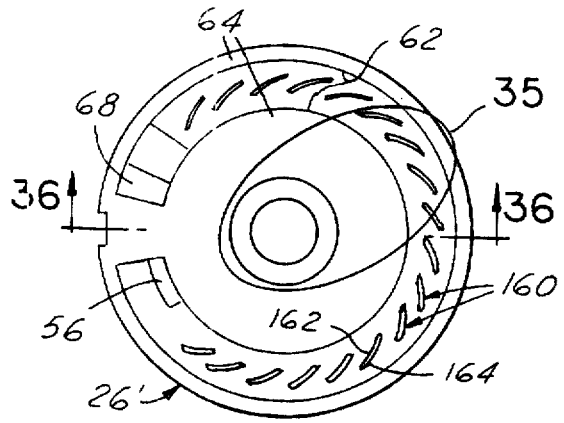
FIG. 34 is a top plan view of a modified pump inlet cap provided with stator vanes and adapted for use as the inlet cap in the pump of FIG. 1.
Figure 35:
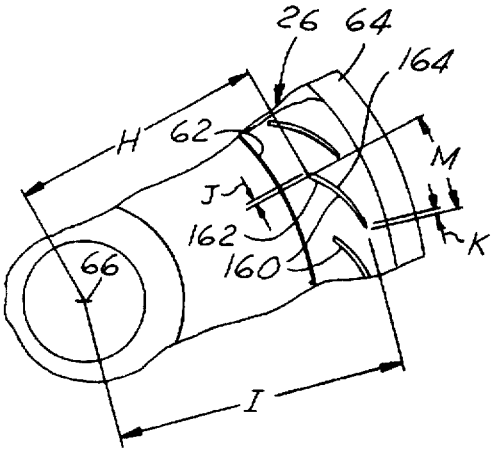
FIG. 35 is a fragmentary plan view of the portion of FIG. 34 encompassed by the circle 35 therein and greatly enlarged thereover.
Figure 36:
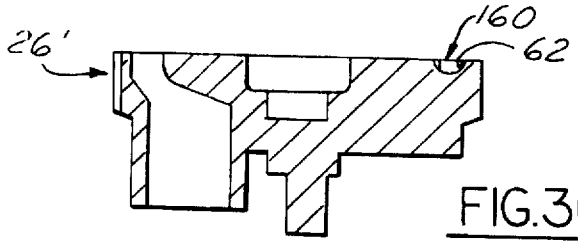
FIG. 36 is a cross sectional view taken on the line 36—36 of FIG. 34.

FIGS. 34–36 illustrate an exemplary test set-up embodiment of a modified pump inlet cap/side plate 26' similar to inlet cap 26 as described previously except for the provision of an annular row of equally spaced stator vanes 160 extending upright from the bottom wall of lower channel section 62 and integrally joined thereto as by casting or injection molding. Vanes 160 may be oriented by experimental iteration to divert and direct liquid flow, exiting axially downwardly from outer blades 120, 120' into channel section 62, further radially towardly from its normal free-flow path toward impeller inner blades 104, 104' (i.e., decreasing the helix angle to increase the pitch number). The vane angulation to produce such diversion is thus calculated empirically to optimize an increase in the number of helical flow cycles imparted to a discrete segment of liquid fuel during its passage from inlet 56 to outlet 60, through pumping channel 52, without unduly introducing flow resistance, in order to thereby vary the efficiency of pump 46. However, it is to be understood that the angulation of stator vanes 160 shown in FIGS. 34 and 35 is neutral, i.e., non-diverting of fuel flow therepast. The leading face 162 and trailing face 164 of each vane 160 are respectively concave and convex surfaces generated as shown by way of example in FIG. 35.

As an experimentation aid, vanes 160 also are useful since they can be constructed at various angulations in a test set-up series of pumps, and pump performances measured to determine the neutral angle for the blades in a given pump design. Empirical verification thus can be obtained of the toroidal fuel flow path or projectory through a given pump channel and associated impeller design. For example, in the illustrated pump assembly of FIGS. 2–12 as described hereinabove, the vane test set-up of FIGS. 34 and 35 caused no improvement in pump performance or efficiency, thereby verifying no need for such vanes in pump 48 as so constructed.

It is also to be understood that the parallelism of vanes 160 shown in FIGS. 34 and 35 may be modified to an angular progression or regression circumferentially of pumping channel 52 by experimental interation to optimize pump efficiency. Vanes 160, whether parallel or of graduated incidence, may be combined either with impellers 48 or 48' having inner and outer rows of blades constructed with the number of blades shown respectively in FIGS. 6 and 14, or having a reduced member of blades in each row (in the order of up to about a 50% reduction) and interblade spacing correspondingly increased to reduce manufacturing cost.

Addition of stator vanes 160 can also be useful feature to change the performance characteristics as desired for a given design of vaneless pump, such as pump 46, without thereby requiring re-design and re-tooling of any remaining components of the pump.

As an additional feature of stator vanes 160, the same may be utilized as a pump output pressure limiting device. That is, the presence of vanes 160 has been found to limit the maximum output pressure of pump 46 to an empirically determined value. When this maximum pressure value is achieved by operation of pump 46, the same goes into a "stall" mode of operation, effectively halting fuel flow both into inlet 56 and out of outlet 60. The pump input energy from motor 30 is thereafter converted to heat energy, which in turn can be safely dissipated to surrounding tank fuel for a predetermined time period, depending upon application conditions. This pressure limiting effect of vanes 160 thus can be utilized, if desired in a suitable system application, to eliminate the need for the usual pressure relief valve normally provided in the pump and/or fuel delivery system fluid circuit.

Second Embodimetn Guide Ring

Figure 37:
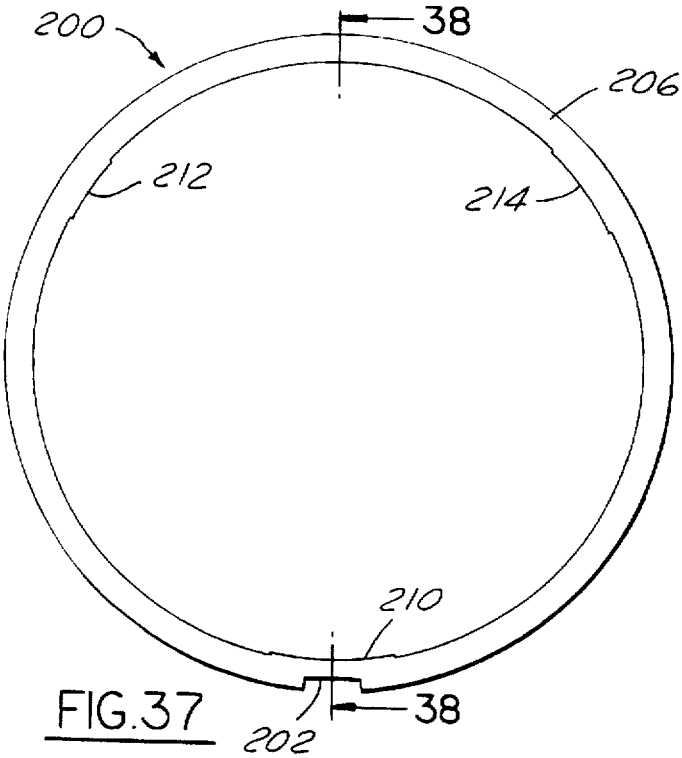
FIG. 37 is a top plan view of a modified guide ring for use in the pump of FIG. 1.
Figure 38:
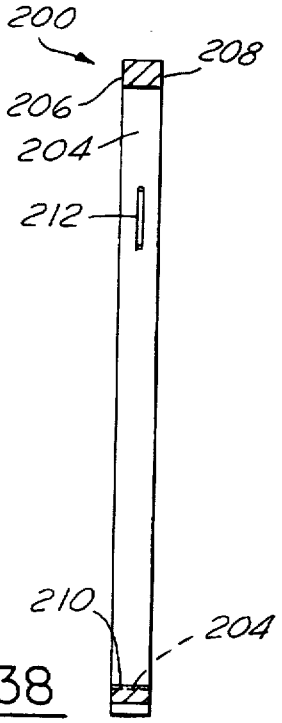
FIG. 38 is a cross sectional view taken on the line 38—38 of FIG. 37.

Referring to FIGS. 37 and 38, a modified guide ring 200 is illustrated which is designed to be substituted for the first embodiment guide ring 80 in pump assembly 46. Guide ring 200, like guide ring 80, is in the form of a cylindrical ring of rectangular radial cross section having the same O.D. as guide ring 80 and same axial thickness. In assembly a single orienting notch 202 is provided in the outer periphery of guide ring 200 which aligns with the single notches in the form of inlet and outlet caps shown in FIGS. 18 and 26.

The inner periphery of guide ring 200 is defined by a cylindrical wall surface 204 extending completely between the top and bottom parallel flat sides 206 and 208 of the guide ring.

Guide ring 200 differs from guide ring 80 in having three equally angularly spaced impeller guide lands 210, 212 and 214 protruding radially inwardly from inner wall surface 204. Land 210 is centered on notch 202 and extends circumferentially a short distance, for example 24°, and extends axially the full distance between top and bottom surfaces 206 and 208 to thereby provide a strengthening section for the ring in the vicinity of notch 202 and to form a fuel stripper dam between the inlet and outlet ports of pumping channel 52. More particularly, guide land 210 in assembly with inlet cap 26 and outlet cap 54 is disposed circumferentially between inlet port 56 and outlet port 60 to close off the radial clearance space between the outer edges of the impeller blades and the guide ring to thereby serve as a fuel stripper or dam between the high and low pressure points of pumping channel 52, and cooperates in this regard with the portions 65 and 73 (FIGS. 3 and 2 respectively) of the inlet cap top face 64 and the outlet cap bottom face 72, respectively that contact one another in assembly to complete the dam between the inlet and outlet ports of the pumping channel.

The remaining two lands 212 and 214 of guide ring 200 are axially very thin, having an axial dimension of approximately 0.2 mm and are centered axially between side faces 206 and 208 of the guide ring. Lands 212 and 214 each extend approximately 15° of the ring circumference. Each of the three lands 210, 212 and 214 have the same radial dimension, namely 0.20 mm, and each have an inner curved surface concentric with surface 204.

The outside diameter of impeller 48 or 48' is made to fit with a zero clearance within the three circumferentially short guide surfaces provided by lands 210, 212 and 214 so that the lands maintain a predetermined radial clearance preferably of 0.20 mm, between the impeller O.D. and main I.D. surface 204 of guide ring 200 in the rotary operation of impeller within the guide ring. The three equally spaced guide lands 210, 2 12 and 214 thus offer minimal frictional contact between the other edges of the impeller blades and the guide rings while maintaining concentric spacing of the impeller within the guide ring to insure this uniform radial clearance between the outermost edges of the outer row blades 120, 120' and ring surface 204. It has been found that providing this very small radial clearance improves the operating efficiency of the pump approximately 1.5% raising overall pump efficiency to about 20% versus a pump construction having a zero clearance fit between the impeller O.D. and the inner peripheral surface 90 of guide ring 80. This is believed to be due to the reduction in frictional drag between the impeller and guide ring provided by this radial clearance therebetween without an offsetting short circuiting leakage loss because of a hydrodynamic fluid sealing action occurring in this radial clearance space.

Guide ring 200 is, like guide ring 80, is very thin axially, having an axial dimension of in one working example of 2.025 mm. Preferably the total axial clearance between the axially opposite top and bottom surfaces of impellers 48 and 48' and the flanking flat faces 72 and 64 of the outlet and inlet caps 54 and 26 is on the order of 0.026 mm (0.013 mm per side).

It is also to be understood that circumferentially continuous grooves or depressions (not shown) may be provided in faces 64 and 72 of inlet and outlet caps 26 and 54 respectively, such grooves being spaced radially inwardly from the channel section grooves 62 and 70 and isolated therefrom by the contacting top and bottom faces of the cap intervening radially between such grooves and the pumping channel sections 62 and 70. Such grooves open up the axial clearance between the cap faces in this grooved area to thereby reduce liquid "windage" or drag effects in the operation of pump 46, i.e., reducing the molecular sheer drag effect of the fluid, particularly liquid film interfaces, when small axial clearances exist between the cap faces and impeller.

What is claimed is:

1. An electric-motor fluid pump that comprises:

a housing including a liquid inlet and a fluid outlet, an electric-motor including a rotor and means for applying electrical energy to said motor to rotate said rotor within said housing; and pump means including an impeller coupled to said motor for co-rotation therewith and having a periphery with a circumferential array of blades arranged in radially outer and inner circular rows concentric with the rotational axis of said impeller, and means forming an arcuate pumping channel surrounding at least a portion of said impeller periphery and communicating at circumferentially opposite first and second ends respectively with said housing inlet and outlet, said pumping channel means including first and second channel section arcuate grooves in said channel means oriented in mutually facing, axially opposed relationship to one another and in side-flanking relationship to said portion of said impeller periphery, said channel grooves extending radially of said impeller co-extensively with said blade rows and communicating axially therewith to define therewith a toroidal fluid flow path extending circumferentially of said impeller between said ends of said pumping channel.

2. The pump set forth in claim 1 wherein said means forming said pumping channel means includes means forming channel inlet and outlet ports at said ends of said arcuate pumping channel means and communicating respectively with said first and second grooves respectively at said first and second ends of said pumping channel.

3. The pump set forth in claim 2 wherein said inlet and outlet ports register with both said rows of said blades.

4. The pump set forth in claim 2 wherein said pumping channel grooves each define an arcuate region axially adjacent to said blade rows of substantially constant cross sectional configuration in any radial plane drawn through the impeller rotational axis and extending circumferentially of said pumping channel for at least the major portion of its circumferential length.

5. The pump set forth in claim 4 wherein the cross sectional area of said cross section of said arcuate region of said first groove is greater than that of said arcuate region of said second groove.

6. The pump set forth in claim 1 wherein said inner row of blades of said impeller define axially open blade pockets closed by wall means at their radially outer edges.

7. The pump set forth in claim 6 wherein said blade pockets comprise circumferential arrays of axially facing through-pockets open on opposed axial side faces of said impeller, each said pocket on each said impeller face opening at said impeller periphery to the axially adjacent one of said channel section grooves.

8. The pump set forth in claim 7 wherein arcuate construction curvilinear arcuate construction defining a convex rear face surface facing in a direction opposite to a direction of impeller rotation and a concave front face surface facing in the direction of impeller rotation.

9. The pump set forth in claim 8 wherein said blades of said inner row have a curvature symmetrical about a lateral central plane of said impeller oriented perpendicular to the impeller rotational axis.

10. The pump set forth in claim 9 wherein said blades of said outer row have a curvature with said face surfaces asymmetrically canted about said central plane with their side edges adjacent said second groove leading their axially opposite side edges adjacent said first groove relative to the direction of impellers rotor rotation.

11. The pump set forth in claim 10 wherein said blades of said inner row have generally the same radial dimension as that of said blades of said outer row.

12. The pump set forth in claim 11 wherein said grooves are radially co-extensive and the depth dimension of said second groove axially thereof is less than that of said first groove.

13. The pump set forth in claim 7 wherein said impeller comprises an inner impeller disc having said inner row of blades formed at its periphery and an outer impeller ring having said outer row of blades formed at its periphery, said ring encircling said disc and being fixed thereto for co-rotation therewith.

14. The pump set forth in claim 13 wherein said ring has a cylindrical inner periphery force fit onto the radially outer edges of said inner row blades and defining the radially outermost wall of said individual blade pockets defined between mutually adjacent blades of said inner row to thereby form part of said wall means.

15. The pump set forth in claim 7 wherein said means forming said pumping channel includes an inlet cap of said pump having a top face defining one side plate for said impeller and containing said first channel section groove, and an outlet cap of said pump having a bottom face defining another side plate for said impeller and containing said second channel section groove therein.

16. The pump set forth in claim 15 wherein said means forming said pumping channel comprises a guide ring sandwiched between said caps and encircling said outer row of blades, said guide ring having an inner periphery adjacent the radially outer edges of said outer row of blades.

17. The pump set forth in claim 16 wherein said guide ring has equally circumferentially spaced impeller guide lands protruding radially inwardly therefrom each having a radially inwardly facing curved surface concentric with said guide ring inner periphery and defining an interrupted cylindrical guide surface for the radially outermost edges of said impeller outer row blades, said guide ring inner periphery and said outermost blade edges defining radially therebetween a small working radial clearance on the order of about 0.20 mm.

18. The pump set forth in claim 15 wherein said first channel section groove is defined by a smooth surface having a cross section radially of said inlet cap with a constant radius of curvature generally centered on the plane of said inlet cap top face and extending for at least major portion of the circumferential length of said first channel section groove, and said second channel section groove is defined by a smooth surface of semi-oval shape in cross section radially of said outlet cap and having an axial depth less than said first groove radius of curvature.

19. The pump set forth in claim 18 wherein at least one of said channel grooves has a row of stator vanes disposed in circumferentially spaced relation therein and individually curved and aligned in the direction of the toroidal fluid flow path for directing fluid flow from said outer row blades into said inner row blades.

20. The pump set forth in claim 18 wherein said first and second channels grooves respectively have a fluid exit explusion ramp and a liquid induction entrance ramp located respectively axially opposite said channel outlet and inlet ports and respectively having leading and trailing edges merging respectively into said first and second channel groove smooth surfaces.

21. The pump set forth in claim 20 wherein said first and second channel grooves respectively have a fluid entry fairing ramp and a liquid exit fairing ramp located respectively generally axially opposite said liquid induction ramp and said fluid exit expulsion ramp, said entry and exit fairing ramps respectively having trailing and leading edges merging respectively into said first and second channel groove smooth surfaces.

22. The pump set forth in claim 7 wherein said impeller comprises a one-piece injection molded plastic part.

23. The pump set forth in claim 15 wherein said channel section grooves extend circumferentially around said cap faces almost all of the circumference thereof so as to leave a circumferentially short space between the circumferentially opposite ends of said grooves, said cap faces extending in face-to-face contact to provide a dam circumferentially between said groove ends to fill said space therebetween.

* * * * *

UNITED STATES PATENT AND TRADEMARK OFFICE

CERTIFICATE OF CORRECTION

PATENT NO. : 5,702,229

DATED : December 30, 1997

INVENTOR(S) : Glenn A. Moss/Edward J. Talaski

It is certified that error appears in the above-indentified patent and that said Letters Patent is hereby corrected as shown below:

Col 4, Lines 3-4, delete "arcuate construction" and insert "each said blade is of".

Col 14, Line 16, change "impellers" to "impeller" and delete "rotor".

Col 14, Line 63, after "least" insert "a".

Col 15, Line 8, change "channels" to "channel".

Signed and Sealed this

FourthDay of August, 1998

Bruce Lehman

*Attest:*

BRUCE LEHMAN

*Attesting Officer*

*Commissioner of Patents and Trademarks*